United States Patent [19]

Roepke et al.

[11] 4,302,053

[45] Nov. 24, 1981

[54] MOUNTING BLOCK TO ROTATE COAL CUTTER BITS

[75] Inventors: Wallace W. Roepke, Excelsior; Richard J. Wilson, Minneapolis, both of Minn.

[73] Assignee: The United States of America as represented by the Secretary of the Interior, Washington, D.C.

[21] Appl. No.: 114,536

[22] Filed: Feb. 23, 1980

[51] Int. Cl.[3] ..... E21C 35/18

[52] U.S. Cl. ..... 299/86; 173/114

[58] Field of Search ..... 299/86; 173/111, 114; 175/299

[56] References Cited

U.S. PATENT DOCUMENTS

| | | | |
|---|---|---|---|
| 798,416 | 8/1905 | Jackson | 173/114 X |
| 1,573,790 | 2/1926 | Rice | 173/111 X |
| 3,539,026 | 11/1970 | Sutliff et al. | 175/299 |
| 3,945,681 | 3/1976 | White | 299/86 |

*Primary Examiner*—Ernest R. Purser

*Attorney, Agent, or Firm*—Thomas Zack; Donald A. Gardiner

[57] ABSTRACT

A rotatable mounting block with a coal cutter bit which reduces the amount of wear to the bit. The cutter bit is fixed within the bore of a bit holder and moves in unison therewith within the mounting block. Positive rotation of the holder/bit is provided by a ratchet sleeve and pawl which interact with spiral slots on the lower extending end of the bit holder. The pawl prevents rotation of the ratchet sleeve in one direction (downward) so that the cutter bit will rotate during movement into the mounting block's bore as inwardly facing sleeve teeth are cammed in the slots of the bit holder. On the upward stroke of the bit/holder within the mounting block, the ratchet sleeve is free to rotate as a strong Belleville spring—also in the mounting block—forces them upward to the original position.

3 Claims, 2 Drawing Figures

MOUNTING BLOCK TO ROTATE COAL CUTTER BITS

BACKGROUND OF THE INVENTION

1. Field of the Invention

The present invention relates to a mounting block for a coal bit. The mounting block rotates the coal bit to provide even wear of the bit. The mounting block utilizes Belleville-Type disk springs.

2. Background of the Prior Art

It has been well known to use cutter bits mounted on bit blocks for cutting through coal seams. A source of excessive wear in coal cutter bits has been the inability of the prior art to provide an effective bit rotator. Previously, attempts have been made to provide bit rotation by loosely mounting the bit within the mount and permitting random vibration to rotate the bit. However, this loose mounting permits coal particles to enter the space between the bit and the mount. The coal particles cause the bit to jam so that rotation of the bit ceases. The resulting wear and damage from impact loading results in shortened bit life, increased cutting forces, increased dust generation and increased methane ignition potential. These wear problems are further magnified when automated mining equipment is applied to harder ores. These problems can be expected to escalate as the development of continuous mining equipment for harder ores progresses.

U.S. Pat. No. 3,945,681 was a prior art attempt to provide bit rotation for a coal cutter bit. In this U.S. Patent, three inclined spiral grooves are included in the cutter bit and a follower is provided in the bore. It is intended that the follower will progress from groove to groove as the cutter bit is driven into the bit holder by impact so as to completely rotate the bit. However, this patent fails to provide any sort of positive continuous incremental rotation means. Without such a means of indexing the follower to the next groove, however, the tendency will be for the follower to return to the same groove. U.S. Pat. No. 3,945,681 also includes stop and thrust load surfaces which come into contact and serve as bearing surfaces for the load imposed on the cutter bit. The high friction forces induced between the two surfaces by the large bit loads will prevent the bit from rotating and thus prevent the follower from advancing to the next groove. When this cycle occurs repetitively, a wear pattern will develop which will preclude the follower from ever advancing to the next groove. A further shortcoming of this invention is the proposed use of helical springs. Although the patent shows a relatively compact helical spring used to return the bit to the outward position, in actual practice a helical spring capable of supplying the required return force over the required length of travel simply does not exist since the small helical spring which could fit within the bore of the bit mount could not supply an adequate force to return the cutter bit to the outward position.

It has also been known to use ribs or other appurtenances on the bit body to force rotation of the cutter bit. However, in these expedients the amount of rotation was based upon the depth of the cut so that there was no consistent rotation to promote symmetric wear and increased bit life.

SUMMARY OF THE INVENTION

It is therefore an object of the present invention to reduce the wear of cutter bits in coal cutting.

It is another object of the present invention to provide a positive incremental rotator for a coal cutter bit.

It is yet another object of the present invention to provide an incremental rotator for a coal cutter bit whose parts are completely enclosed within the mounting block.

It is a final object of the present invention to provide an incremental rotator for a coal cutting bit which utilizes a Belleville-type disk spring.

According to the present invention, a standard cutter bit is located within a bore of a cutter bit block. The end of the standard cutter bit within the bit block is provided with one or more spiral slots or the standard cutter bit is screwed into a bit holder which is provided with spiral slots. The movement of the cutter bit into the bore is opposed by a Belleville-type disk reset spring located within the bore. Also located within the bore is a ratchet sleeve having ratchet teeth on its outer surface and guide teeth on its inner surface in contact with the spiral slots. The ratchet teeth can communicate with a pawl to permit rotary motion of the ratchet sleeve in one direction only. Therefore, when the cutter bit is forced into the bore by coal cutting action, the pawl prevents rotary motion of the ratchet sleeve so that the spiral slots and guide teeth force the cutter bit to rotate as it moves into the bit block. After the coal cutting action, the Belleville-type disk return spring forces the cutter bit outward. The frictional force between the cutter bit or the bit holder and the bore surface is arranged to be relatively high so that, in the outward movement of the cutter bit, the ratchet sleeve rotates while the cutter bit moves axially without rotation. Positive rotation of the cutter bit is thereby provided.

All moving parts except the cutter end of the bit are internal to the bit block thereby offering protection against outside contamination.

The use of the Belleville-type disk springs permits a compact mounting arrangement which is able to fit within the bit block. The application of this simple, rugged, automatic mechanical impact generating device to continuous miner blocks is possible.

As the bit of the present invention, a standard bit can be used with minimal or no modification.

BRIEF DESCRIPTION OF THE DRAWINGS

Various other objects, features and attendant advantages of the present invention will be more fully appreciated as the same becomes better understood from the following detailed description when considered in connection with the accompany drawings, wherein like reference characters designate like or corresponding parts throughout the several views, and wherein.

DETAILED DESCRIPTION OF THE PREFERRED EMBODIMENTS

Figure 1:
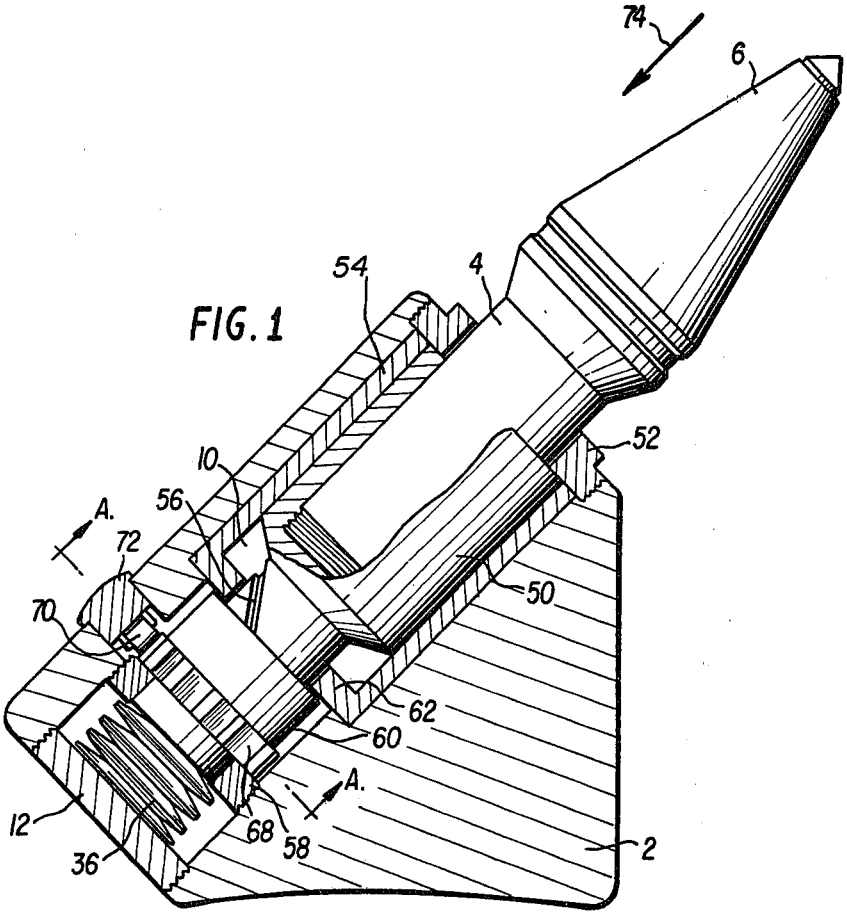
FIG. 1 is a cross-sectional view of the invention in which cutter bit rotation is provided.
Figure 2:
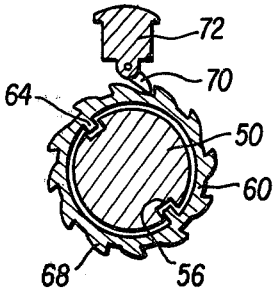
FIG. 2 is a sectional view along line AA of FIG. 1.

The present invention, in which a bit rotator is included in the mounting block, is illustrated in FIGS. 1 and 2. A standard cutter bit 4 is preferably mounted in a bit holder 50 within the bore 10. The cutter bit can be mounted to the bit holder in one of several ways, for example by the use of screwthreads provided in a direction which tightens the screwthreads upon the rotation of the cutter bit. The bit holder is prevented from moving out of the bore 10 by retainer ring 52.

The bit holder 50 slides against bushing 54 of the bore 10 during the axial movement of the bit holder. The frictional force existing between the bit holder and the bushing 54 during the sliding motion of the bit holder can be predetermined by the proper selection of material finishes and tolerances.

The rear end of the bit holder includes one or more spiral grooves (2 are shown in FIG. 2) 56. The rear end of the bit holder is mounted for rotation by bushing 58 and is contacted by Belleville-type disk spring 36 which opposes the axial movement of the bit holder into the bore. A ratchet sleeve 60 surrounds the rear end of the bit holder and is prevented from moving axially by the flange 62 of the bushing 54 and by the bushing 58. The ratchet sleeve includes guide teeth 64 on its inner surface which interfit with the spiral slots 56. The outer surface of the ratchet sleeve includes a circumferential ring of ratchet teeth 68. A pawl 70 mounted on a pawl mounting assembly 72 permits the ratchet sleeve to rotate in only one direction about the axis of the bore 10.

The materials and tolerances of the bit holder and bushing 54 are selected so that the friction therebetween is greater than the ratcheting friction of the ratchet sleeve.

In operation, the bit block is mounted for rotary drum rotation so that the cutter bit contacts coal or other material to be mined. The force of the contact causes the cutter bit to retract into the bore against the restoring force of the spring 36. As it retracts, there results axial movement between the ratchet sleeve 60 and the bit holder 50 since the ratchet sleeve is unable to move axially. The spiral groove 56 therefore provides the guide teeth 64 with clockwise rotative reaction forces, as seen from the direction of arrow 74. However, because of pawl 70, the ratchet sleeve 68 and the guide teeth 64 attached thereto are unable to rotate in the clockwise direction. The reaction forces between the spiral slots 56 and the guide teeth 64 therefore cause the bit holder and the cutter bit to rotate in the counter clockwise direction.

Following the release of the cutting forces on the cutter bit, the spring 36 urges the bit holder and cutter bit to return to their initial position as seen in FIG. 1. As the bit holder 50 and the cutter bit 4 return to their initial position, the inability of the ratchet sleeve to move in the axial direction again results in rotative reaction forces between the guide teeth 64 and the spiral slots 56, these rotative reaction forces urging the ratchet sleeve 60 rotate in the counterclockwise direction. Since the pawl only prevents rotation of the ratchet sleeve in the clockwise direction, and since the frictional force between the bit holder 50 and the bushing 54 is greater than the ratcheting frictional force, the bit holder and cutter bit return to their initial position while the ratchet sleeve rotates. The result is the positive rotation of the cutter bit for each set of inward and outward axial movements of the cutter bit and bit holder within the bore 10.

Although this embodiment has been described with the spiral slots on the bit holder 50 and the guide teeth on the ratchet sleeve 60, the apparatus would work equally well with the spiral slots on the ratchet sleeve and the guide teeth on the bit holder. Similarly, the ratchet teeth could be reversed so that the cutter bit rotates upon its return to its original position rather than upon its retraction into the bore.

The Belleville-type disk spring permits all of the elements to be contained within the bit block for protection against contamination by debris since it is able to provide large spring return forces for small degrees of deflection so that a small bit block may be used. A standard cutting bit could be used without modification except for the additional of screwthreads for connection to the bit holder.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A combined mounting block and rotatable coal cutting bit assembly comprising:

a mounting block having an axial bore therein;

a bit holder mounted in said bore and capable of being moved axially therein between a first and second position;

a coal cutting bit rigidly fixed in the bit holder and movable in unison axially therewith, said bit having a cutting end extending from the bore;

a Belleville-type disk spring located in the block's bore remote from the bit's cutting end to bias the holder and bit outwardly from the bore;

means to retain the bit holder and bit in the bore against the biasing action of the spring;

a groove guide in the bit holder near the end opposite the bit's cutting end; and bit holder control means for engaging the groove and allowing the bit holder and bit to rotate and index as the holder moves from its first to second axially position, said control means preventing the bit holder and bit from rotating when the bit holder moves from its second to first position.

2. The assembly of claim 1 wherein:

said control means has a rotatable ratchet sleeve encircling the bit holder, a pawl to engage said sleeve, said sleeve having at least one guide to engage the groove and also a series of outer members to engage the pawl whereby the pawl prevents rotation of the sleeve when the bit holder moves from its first to second axial position, said pawl allowing the sleeve to rotate when the bit holder moves from its second to first axial position.

3. The assembly of claim 1 wherein:

the means to retain the bit holder is a retaining collar surrounding the bit holder, said collar being mounted in the block.

* * * * *